US012446678B2

(12) United States Patent
Chen et al.

(10) Patent No.: US 12,446,678 B2
(45) Date of Patent: Oct. 21, 2025

(54) EYE CREAM PACKAGING MATERIAL

(71) Applicants: Shanghai Yingyu Packaging Technology Co., Ltd., Shanghai (CN); Beijing Plant Doctor Biotechnology Co., Ltd., Beijing (CN)

(72) Inventors: Jianhai Chen, Shanghai (CN); Yong Xie, Beijing (CN); Xiuwei Shi, Shanghai (CN)

(73) Assignees: Shanghai Yingyu Packaging Technology Co., Ltd.; Beijing Plant Doctor Biotechnology Co., Ltd.

( * ) Notice: Subject to any disclaimer, the term of this patent is extended or adjusted under 35 U.S.C. 154(b) by 491 days.

(21) Appl. No.: 17/922,740

(22) PCT Filed: Jan. 21, 2022

(86) PCT No.: PCT/CN2022/073244
§ 371 (c)(1),
(2) Date: Nov. 1, 2022

(87) PCT Pub. No.: WO2022/170941
PCT Pub. Date: Aug. 18, 2022

(65) Prior Publication Data

US 2023/0165355 A1 Jun. 1, 2023

(30) Foreign Application Priority Data

Feb. 9, 2021 (CN) ..... 202120361018.X

(51) Int. Cl.
*A45D 40/22* (2006.01)

(52) U.S. Cl.
CPC ..... *A45D 40/222* (2013.01); *A45D 2200/054* (2013.01)

(58) Field of Classification Search
CPC ..... A45D 40/222; A45D 2200/054
See application file for complete search history.

(56) References Cited

U.S. PATENT DOCUMENTS 8,240,518 B2 * 8/2012 Canfield ..... B05B 11/00446 222/386
2009/0166383 A1 * 7/2009 Canfield ..... B05B 11/1032 222/207

FOREIGN PATENT DOCUMENTS

CN 110505818 A * 11/2019 ..... A45D 33/00
JP 2020000663 A * 1/2020
WO WO-2018181965 A1 * 10/2018 ..... A45D 33/00

OTHER PUBLICATIONS

Machine Translation of CN 110505818.*
Machine Translation of JP 2020000663.*

* cited by examiner

*Primary Examiner* — Jeremy Carroll

(57) ABSTRACT

An eye cream packaging container that includes an outer bottle wherein a material accommodating assembly is arranged in the outer bottle, and a material dispensing assembly is connected to a bottleneck of the outer bottle; the material accommodating assembly has an inner container and a flexible material bag arranged, and the inner container has multiple through openings; the material dispensing assembly has a middle seat, a middle seat inner cover and a flexible manual press cap; the middle seat inner cover is arranged in the middle seat, the middle seat inner cover is connected to outside of the bottleneck, and a one-way valve plug is arranged in the middle seat inner cover; and the flexible manual press cap is arranged at the top of the middle seat inner cover, and the middle of the flexible manual press cap is provided with a pressing region and a discharging region.

11 Claims, 10 Drawing Sheets

EYE CREAM PACKAGING MATERIAL

TECHNICAL FIELD

This invention generally relates to the technical field of containers for fluid materials, and more particularly, to an eye cream packaging material capable of preventing the introduction of air when taking a fluid material out from a container.

BACKGROUND

Fluid materials are normally stored in containers. For example, cosmetic materials are normally stored in bottles. Some of the fluid materials have an inclination to deteriorate when they come in contact with air. Therefore, to ensure its quality, a fluid material must be kept in containers in a closed state and isolated from air during the compounding process.

An eye cream is a skin care cosmetic used for the skin around eyes. Except for moisturizing and shielding functions, it may also possess functions such as tightening the skin around eyes, relieving under-eye dark circles, as well as alleviating wrinkles and fine lines after the addition of various functional components and active substances.

An eye cream bottle is a container for storing an eye cream. During the compounding process, for conventional eye cream bottles, the introduction of air or impurities is inevitable, resulting in poor quality and shortened service life of the eye cream in the container. Yet worse, when the interior of the container circulates with the outside air, the odor and the active substances of the eye cream are changed.

SUMMARY

The purpose of the present invention is to provide an eye cream packaging container, capable of preventing outside air and foreign objects from entering a container, thereby guaranteeing the quality of a fluid material in the container.

To achieve the above purpose, the present invention adopts the following technical solution: an eye cream packaging container, comprising an outer bottle, wherein a material accommodating assembly for accommodating a fluid material to be dispensed is arranged in the outer bottle, and a bottleneck of the outer bottle is connected with a material dispensing assembly for allowing the fluid material in the material accommodating assembly to be pressed out;

The material accommodating assembly 2 comprises an inner container and a flexible material bag arranged in the inner container; the upper end edge of the inner container is connected to the top of the bottleneck of the outer bottle, and the upper end edge of the flexible material bag is sleeved outside the outer edge of the upper end of the inner container; the flexible material bag is flexible and deformable, and the inner container is provided with a plurality of through openings;

The material dispensing assembly comprises a middle seat, a middle seat inner cover and a flexible manual press cap; the middle seat is a structure provided with an upper opening and a lower opening; the middle seat inner cover is arranged in the middle seat, and the middle seat inner cover is connected to the exterior of the bottleneck of the outer bottle; a negative pressure one-way valve plug is arranged in the middle seat inner cover.

A flexible manual press cap is arranged at the top of the middle seat inner cover in an airtight manner, and the middle of the flexible manual press cap is provided with a convex pressing region and a convex discharging region that are adjacent to each other; a discharging notch is formed in the discharging region; the pressing region and the discharging region are provided with a small cavity, and the pressing region is located on the upper side of the one-way valve plug; the pressing region and the one-way valve plug are substantially in a straight line.

When the pressing region is pressed to deform, a negative pressure is formed in the pressing region, and when the pressing region is released, the pressing region is restored to an original state under its own elasticity. During this process, the one-way valve plug is capable of sucking the fluid material in the flexible material bag up and propelling the soft material bag to deform and contract to open the discharging notch.

In another embodiment of the present invention, the middle seat inner cover is provided with a through hole, and the one-way valve plug is arranged in the through hole. A plurality of anti-blocking columns are arranged at the bottom of the one-way valve plug along the periphery of the lower end of the through hole, and a through opening is formed between every two adjacent anti-blocking columns.

In another embodiment of the present invention, the bottom of the flexible manual press cap is provided with a manual press cap tray, and the top of the middle seat inner cover is provided with an annular protruding edge. The manual press cap tray is connected to the annular protruding edge.

In another embodiment of the present invention, the upper end edge of the flexible material bag interacts with the upper end edge of the inner container and the middle seat inner cover in an airtight manner.

In another embodiment of the present invention, the top of the middle seat is connected to a flip cover, and when the flip cover is in a closed state, the opening at the top of the middle seat is sealed.

In another embodiment of the present invention, the flip cover comprises an inner cover and an outer cover arranged outside the inner cover. The outer side wall of the inner cover is provided with an inner cover notch. A clamping platform is arranged on the inner side wall of the upper portion of the middle seat, and a clamping groove is formed in the clamping platform. The inner cover notch and the clamping groove formed in the clamping platform are rotatably connected through a hinge assembly.

In another embodiment of the present invention, the hinge assembly comprises a crank arm connector, a spring and a pin. The lower end of the crank arm connector is provided with a connecting shaft, and the upper side of the crank arm connector is provided with a via hole. The connecting shaft is fixed in the clamping groove, the pin penetrates through the via hole, and the two ends of the pin are fixed in two ports formed in the inner wall of the inner cover notch. The spring is sleeved outside the pin, one end of the spring is inserted into the via hole, and the other end of the spring abuts against the inner wall of the outer cover.

In another embodiment of the present invention, the wall thickness of the flexible material bag is consistent. The flexible material bag is made of one of materials selected from silica gel, thermoplastic elastomer, thermoplastic rubber and styrenic thermoplastic elastomer.

In another embodiment of the present invention, both the inner container and the flexible material bag are configured to be a shape selected from a hollow cylinder, a cube, a cuboid, a prism or a circular truncated cone. Both the top of the inner container and the top of the flexible material bag are open. The plurality of through openings formed in the inner container allow the interior of the inner container to communicate with the outside air.

In another embodiment of the present invention, the one-way valve plug and the flexible manual press cap are made of one of materials selected from silica gel, thermoplastic elastomer, thermoplastic rubber and styrenic thermoplastic elastomer, and the one-way valve plug is arranged in a direction from the flexible material bag to the cavity in the pressing region.

In another embodiment of the present invention, the fluid material is one material selected from an eye cream, a drug, an aqueous solvent and an emulsion.

In another embodiment of the present invention, the inner bottom of the inner container is provided with a plurality of ribs, and the bottom of the inner container is provided with a ventilation opening.

Compared with the prior art, the present invention has the following advantages:

When the pressing region is pressed to deform and contract, a negative pressure is formed in the pressing region, and a pressure difference is generated between the two sides one-way valve plug. When the pressing region is released, the pressing region is restored to an original state under its own elasticity. During this process, the one-way valve plug is capable of sucking the fluid material in the flexible material bag up and propelling the soft material bag to deform and contract to open the discharging notch. At this point, when the pressing region is pressed, a certain amount of the fluid material in the pressing region flows into the discharging region and is discharged from the discharging notch. The one-way valve plug enables the interior of the flexible material bag to be isolated from outside air and foreign objects, thereby guaranteeing the quality of the fluid material.

Figure 1:
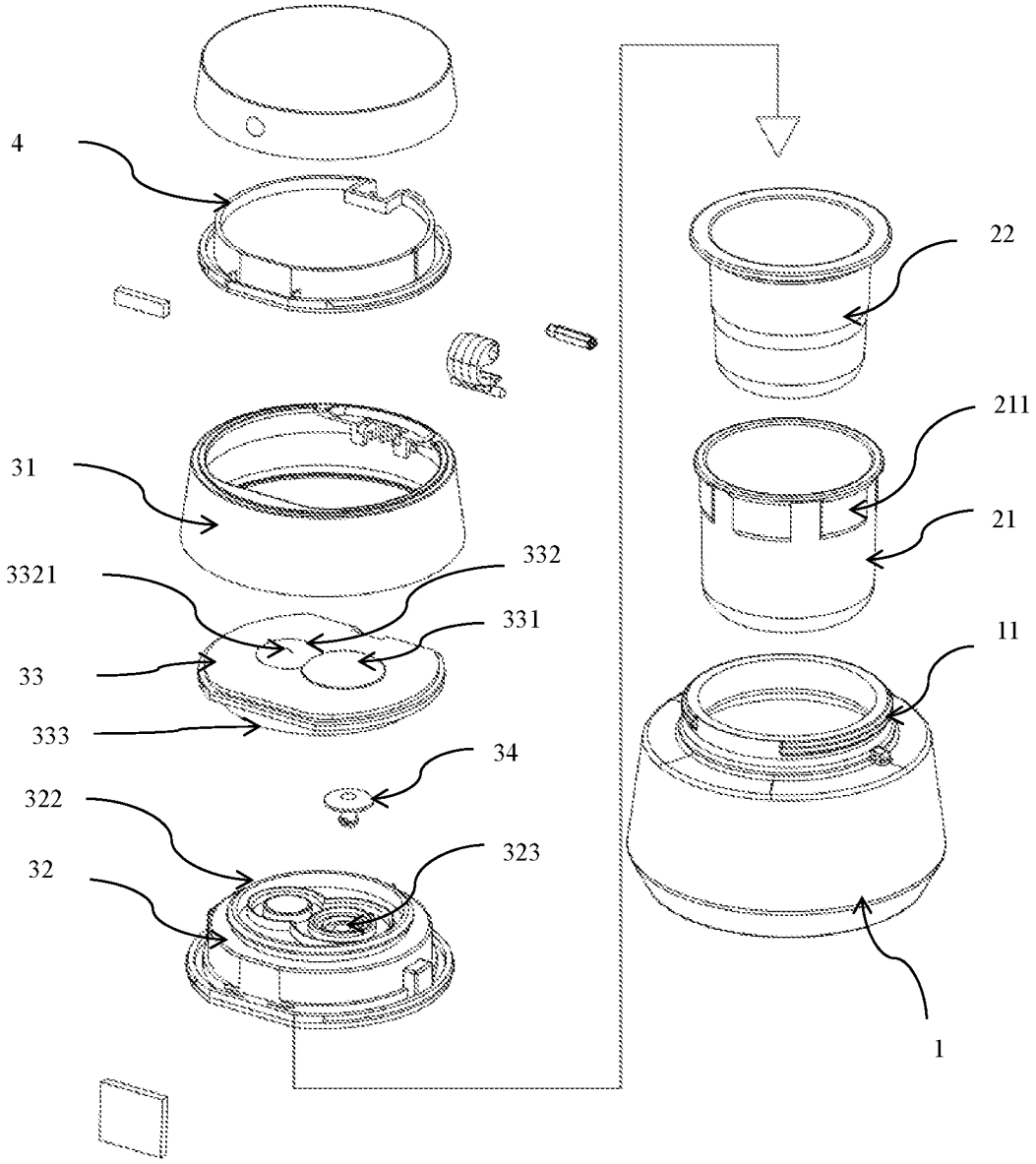
FIG. 1 is a conceptual diagram illustrating an explosive view of the eye cream packaging container in embodiment 1 of the present invention.

Marking Instructions in Figures: 1—Outer Bottle, 11—Bottleneck, 2—Material Accommodating Assembly, 21—Inner Container, 211—Through Opening, 212—Rib, 213—Ventilation Opening, 22—Flexible Material Bag, 3—Material Dispensing Assembly, 31—Middle Seat, 311—Clamping Platform, 312—Clamping Groove, 32—Middle Seat Inner Cover, 321—Anti-blocking Column, 322—Annual Protruding Edge, 323—Through Hole, 33—Flexible Manual Press Cap, 331—Pressing Region, 332—Discharging Region, 3321—Discharging Notch, 333—Manual Press Cap Tray, 34—One-way Valve Plug, 4—Flip Cover, 41—Inner Cover, 411—Inner Cover Notch, 412—Port, 42—Outer Cover, 5—Fluid Material, 6—Hinge Assembly, 61—Crank Arm Connector, 611—Connecting Shaft, 612—Via Hole, 62—Spring, 63—Pin.

DETAILED DESCRIPTION

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

In the description of the present invention, it should be understood that the orientations or positions indicated by the terms "upper", "lower", "inner" and "outer" are defined based on the relative positions of the parts in the drawings of the present invention. These terms are merely for the convenience of describing and simplifying the technical solution of the present invention. Thus, they cannot be understood as a limitation of the present invention.

In the description of the present invention, unless it is clearly stated, the terms "arranged" and "connected" shall be understood in a broad sense. For instance, it may be a fixed connection, a detachable connection, an integrated connection, a direct connection, an indirect connection through an intermediate medium. For those skilled in the art, the specific meanings of the above terms in the present invention may be understood according to specific circumstances.

Embodiment 1

Figure 2:
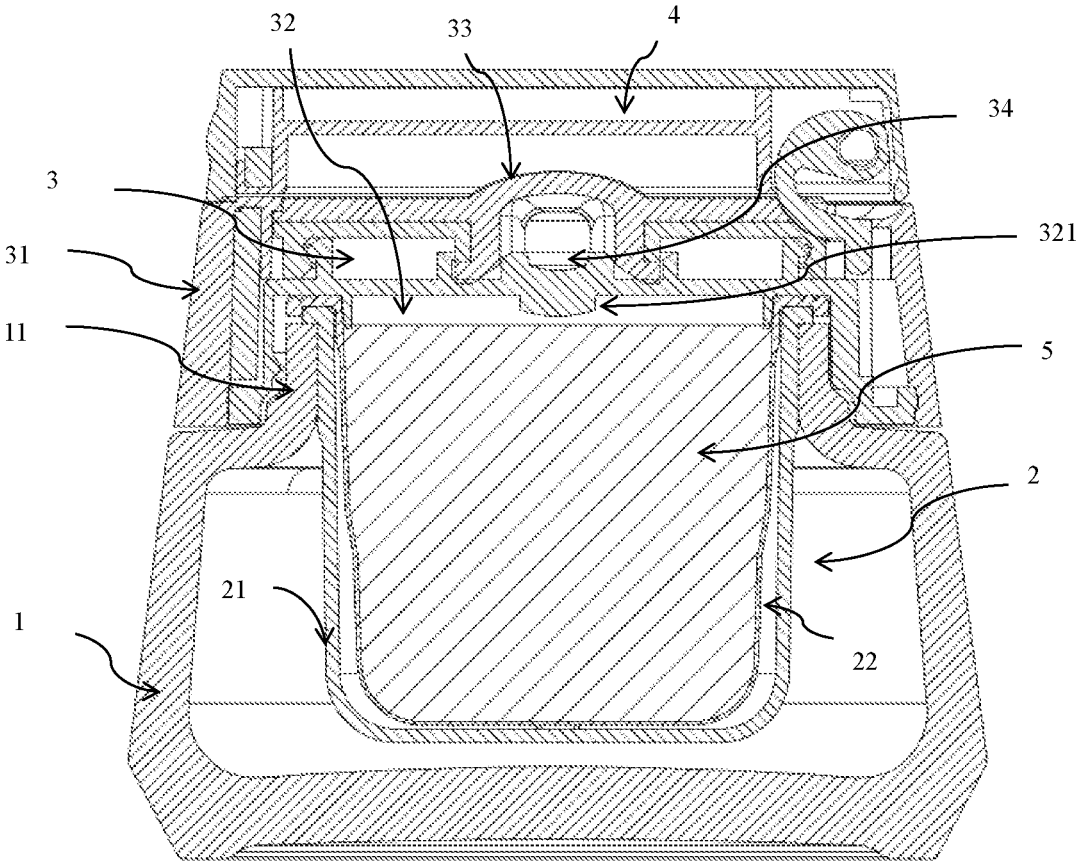
FIG. 2 is a conceptual diagram illustrating a sectional view of the eye cream packaging container in embodiment 1 of the present invention.
Figure 3:
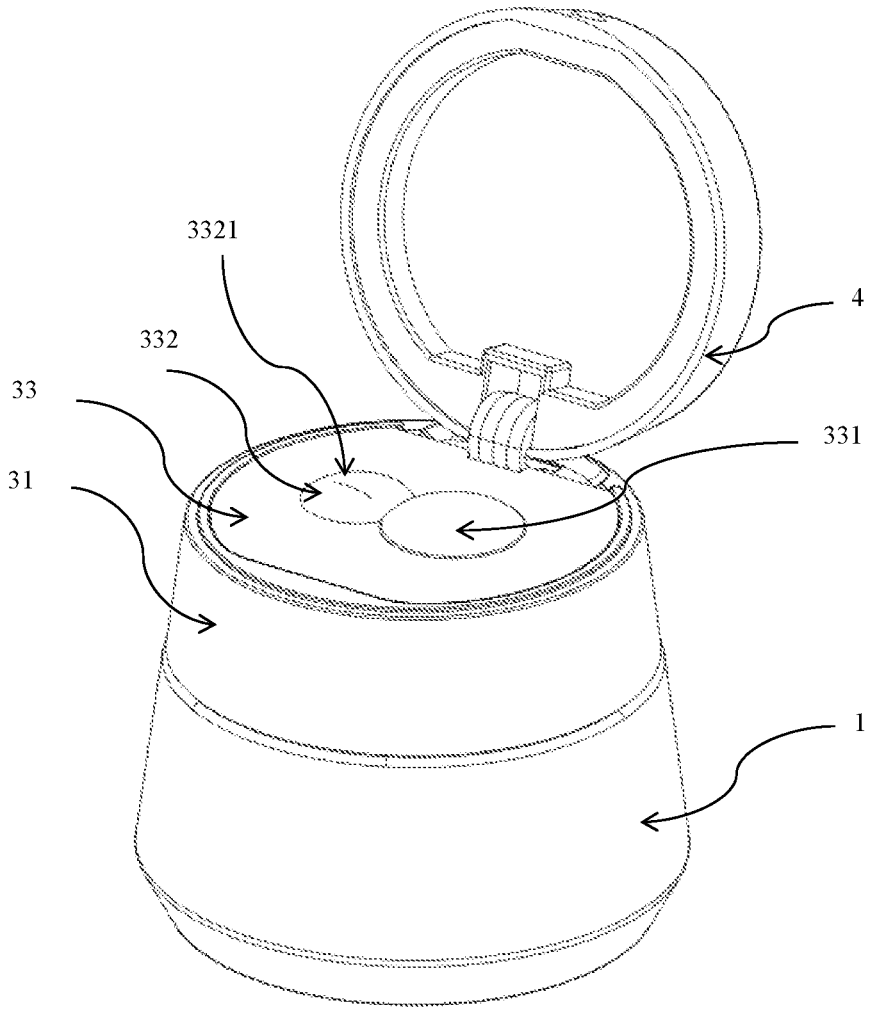
FIG. 3 is a conceptual diagram illustrating a three-dimensional structure of the eye cream packaging container in embodiment 1 of the present invention.

Referring to FIGS. 1, 2 and 3, FIG. 1 is a conceptual diagram illustrating an explosive view of the eye cream packaging container of the present invention, FIG. 2 is a conceptual diagram illustrating a sectional view of the eye cream packaging material of the present invention, and FIG. 3 is a conceptual diagram illustrating a three-dimensional structure of the eye cream packaging material of the present invention.

The eye cream packaging container of the present invention, comprising an outer bottle (1), wherein a material accommodating assembly 2 for accommodating a fluid material 5 to be dispensed is arranged in the outer bottle 1, a bottleneck 11 of the outer bottle 1 is connected with a material dispensing assembly 3 for allowing the fluid material 5 in the material accommodating assembly 2 to be pressed out, wherein air is prevented from being introduced during the whole process.

The material accommodating assembly 2 comprises an inner container 21 and a flexible material bag 22 arranged in the inner container 21. The flexible material bag 22 is independent from the inner container 21 and is obtained by means of injection molding of silica gel. The wall thickness of the flexible material bag 22 is consistent. The upper end edge of the inner container 21 is connected to the top of the bottleneck 11 of the outer bottle 1, and the upper end edge of the flexible material bag 22 is sleeved outside the outer edge of the upper end of the inner container 21. When the flexible material bag 22 contracts, its internal space is reduced, and a space exists between the inner container 21 and the flexible material bag 22. The upper side of the inner container 21 is provided with a plurality of through openings 211 for allowing air to flow into the space between the inner container 21 and the flexible material bag 22, thereby ensuring the contraction of the flexible material bag 22 under the negative pressure suction.

The flexible material bag 22 is flexible and deformable, and its interior is capable of storing a fluid material 5 (e.g., a fluid cosmetic). The fluid material 5 is in a volume defined by the flexible material bag 22, and the fluid material 5 does not need to occupy the entire volume defined by the flexible material bag 22, while other substances may occupy the entire volume defined by the flexible material bag 22.

The material dispensing assembly 3 comprises a middle seat 31, a middle seat inner cover 32 and a flexible manual press cap 33. The middle seat 31 is a structure provided with an upper opening and a lower opening. The middle seat inner cover 32 is arranged in the middle seat 31, the middle seat inner cover 32 is connected to the outside of the bottleneck 11 of the outer bottle 1. The middle seat 31 plays a role in protecting the middle seat inner cover 32, and the middle seat inner cover 32 is located directly above the flexible material bag 22. A negative pressure one-way valve plug 34 is arranged in the middle seat inner cover 32, and the one-way valve plug 34 is communicated with the flexible material bag 22 for sucking the fluid material 5 in the flexible material bag 22.

A flexible manual press cap 33 is arranged at the top of the middle seat inner cover 32 in an airtight manner, and the middle of the flexible manual press cap 33 is provided with a convex pressing region 331 and a convex discharging region 332 that are adjacent to each other. The pressing region 331 and the discharging region 332 have convex arc surfaces, and a discharging notch 3321 is formed in the discharging region 332. The pressing region 331 and the discharging region 332 are provided with a small cavity, and the pressing region 331 is located on the upper side of the one-way valve plug 34. The pressing region 331 and the one-way valve plug 34 are substantially in a straight line, thereby allowing the one-way valve plug 34 to suck the fluid material 5 in the flexible material bag 22 into the cavity in the pressing region 331.

When the pressing region 331 is pressed to deform, a negative pressure is formed in the pressing region 331, and when the pressing region 331 is released, the pressing region 331 is restored to an original state under its own elasticity. During this process, the one-way valve plug 34 is capable of sucking the fluid material 5 in the flexible material bag 22 up and propelling the soft material bag 22 to deform and contract to open the discharging notch 3321. At this point, when the pressing region 331 is pressed, a certain amount of the fluid material 5 in the pressing region 331 flows into the discharging region 332 and is discharged from the discharging notch 3321. When the pressing region 331 is released, the discharging notch 3321 is closed.

Further, the middle seat inner cover 32 is provided with a through hole 323, and the one-way valve plug 34 is arranged in the through hole 323. When the fluid material 5 in the flexible material bag 22 is consumed to a certain extent, the flexible material bag 22 deforms and contracts to approach the one-way valve plug 34. Under such circumstances, the one-way valve plug 34 is easily blocked, resulting in the failure of completely discharging the fluid material 5 in the flexible material bag 22. Therefore, a plurality of anti-blocking columns 321 are arranged at the bottom of the one-way valve plug 34 along the lower portion of the through hole 323, and a through opening is formed between every two adjacent anti-blocking columns 321. As long as one of the through openings operates normally, a smooth suction of the one-way valve plug 34 is ensured.

In another preferred embodiment, the bottom of the flexible manual press cap 33 is provided with a manual press cap tray 333, and the top of the middle seat inner cover 32 is provided with an annular protruding edge 322. The manual press cap tray 333 is connected to the annular protruding edge 322, and the one-way valve plug 34 is located in an area enclosed by the annular protruding edge 322. The manual press cap tray 333 is made of a hard PC material, and the manual press cap tray 333 may be connected to the annular protruding edge 322 in any suitable ways, including a threaded connection or snap-fit engagement. For the snap-fit engagement, the manual press cap tray 333 and the annular protruding edge 322 may adopt a known structure of the prior art.

Furthermore, the upper end edge of the flexible material bag 22 interacts with the upper end edge of the inner container 21 and the middle seat inner cover 32 in an airtight manner, thereby ensuring that the flexible material bag 22 is in a closed state and the inside of the flexible material bag 22 is isolated from the outside air and foreign objects.

To prevent the manual press cap 33 from being pressed mistakenly and make the container aesthetically appealing, the top of the middle seat 31 is connected to a flip cover 4, and when the flip cover 4 is in a closed state, the opening at the top of the middle seat 31 is sealed.

When the container is no longer used, the one-way valve plug 34 blocks the through hole 323 such that the flexible material bag 22 is isolated from the exterior. Moreover, the flip cover 4 enables the fluid material 5 in the flexible material bag 22 to be stored for a prolonged period. When there is a need to use the container, the flip cover 4 is opened and the pressing region 331 is pressed such that the cavity in the pressing region 331 is compressed. In this way, the fluid material 5 in the pressing region 331 enters the discharging region 332, and a certain amount of the fluid material 5 in the discharging region 332 is discharged from the discharging notch 3321. Through the aforesaid operation, the discharging amount of the fluid material 5 is conveniently controlled.

After a proper amount of the liquid material 5 is discharged, the pressing region 331 is released, and the pressing region 331 is restored to an original state under its own elasticity. At this point, the cavity in the pressing region 331 possesses a certain vacuum pressure, so that the one-way valve plug 34 is opened, and the flexible material bag 22 deforms and contracts to propel the fluid material 5 to move upwards. In this way, the fluid material 5 enters the cavity in the pressing region 331 through the one-way valve plug 34 until a pressure balance in the cavity of the pressing region 331 is achieved.

Further, both the inner container 21 and the flexible material bag 22 are configured to be a hollow cylindrical shape, and both the top of the inner container 21 and the top of the flexible material bag 22 are open. The plurality of through openings 211 formed in the inner container 21 allow the interior of the inner container 21 to communicate with the outside air. The flexible material bag 22 is made of a silica gel material, which facilitates the deformation and contraction of the flexible material bag, thereby allowing the fluid material 5 to be discharged without the introduction of air. When the fluid material 5 in the flexible material bag 22 is completely discharged, the flexible material bag 22 retracts, and the space inside the flexible material bag 22 for containing the fluid material 5 disappears.

It should be understood that the device of the present invention is not limited to the specific forms disclosed. Contrarily, all variants, equivalents and alternatives of the device of the present invention shall fall into the scope defined by the claims. For example, although the device of the present invention is particularly suitable for use with a fluid cosmetic, for those skilled in the art, the device of the present invention may be used for other fluid materials 5.

In another preferred embodiment, although the inner container 21 and the flexible material bag 22 are configured to be a cylindrical shape, other shapes such as a cube, a cuboid, a prism or a circular truncated cone may also be employed. In addition, although the flexible material bag 22 is preferably an integral piece made of silica gel, other flexible deformable materials such as thermoplastic elastomer, thermoplastic rubber and styrenic thermoplastic elastomer may also be employed.

In this embodiment, the one-way valve plug 34 and the flexible manual press cap 33 are made of one of materials selected from silica gel, thermoplastic elastomer, thermoplastic rubber and styrenic thermoplastic elastomer, and the one-way valve plug 34 is arranged in a direction from the flexible material bag 22 to the cavity in the pressing region 331. In different embodiments, the material of the outer bottle 1 and the flip cover 4 may be translucent, transparent, semi-transparent or opaque.

Furthermore, the fluid material 5 may be one selected from an eye cream, a drug, an aqueous solvent and an emulsion, or the fluid material 5 may be any other fluid cosmetics.

Figure 4:
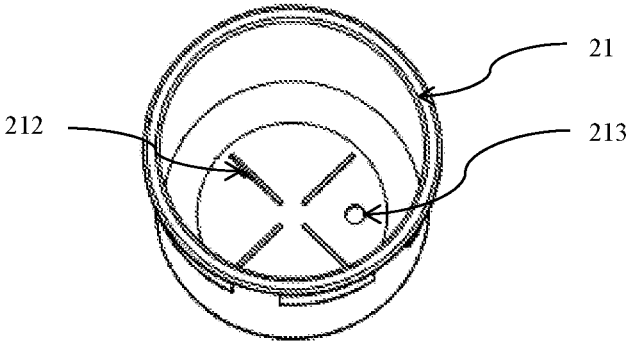
FIG. 4 is a conceptual diagram illustrating a three-dimensional structure of the inner container in embodiment 1 of the present invention.
Figure 5:
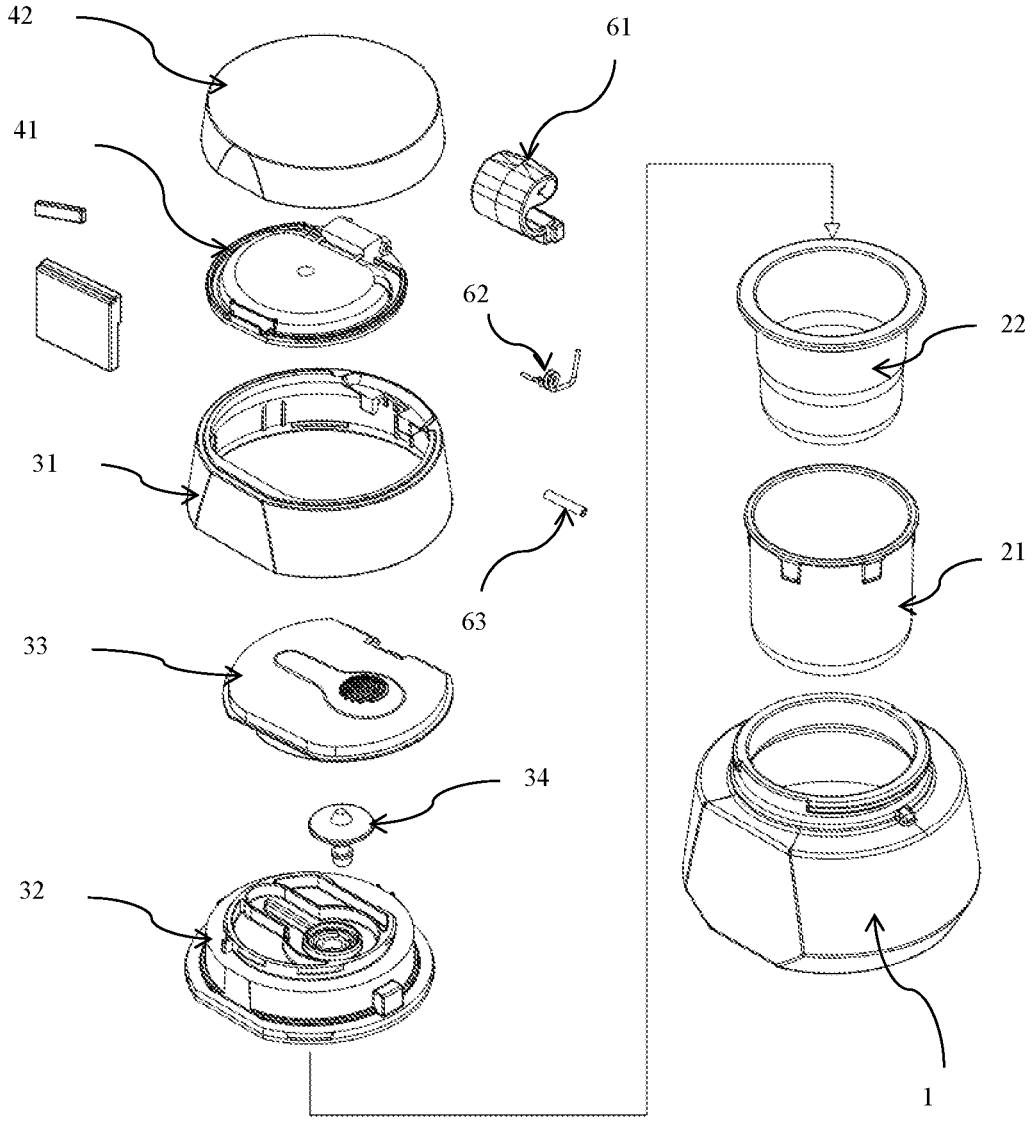
FIG. 5 is a conceptual diagram illustrating an explosive view of the eye cream packaging container in embodiment 2 of the present invention.
Figure 6:
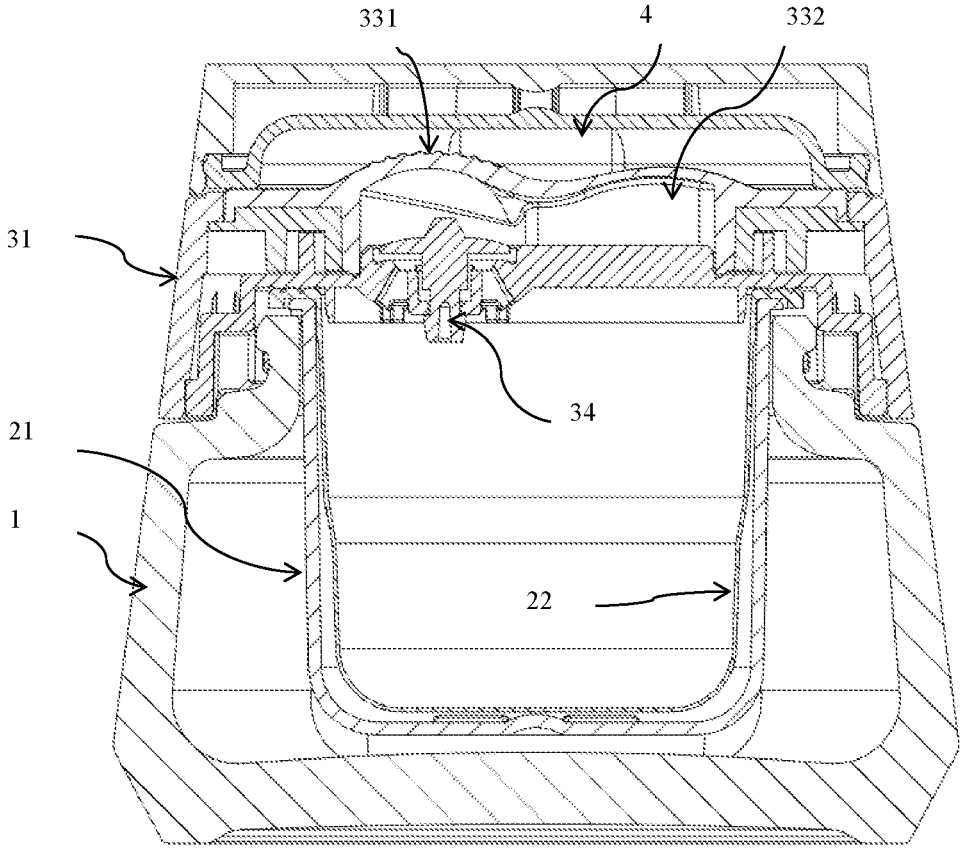
FIG. 6 is a conceptual diagram illustrating a sectional view of the eye cream packaging container in embodiment 2 of the present invention.
Figure 7:
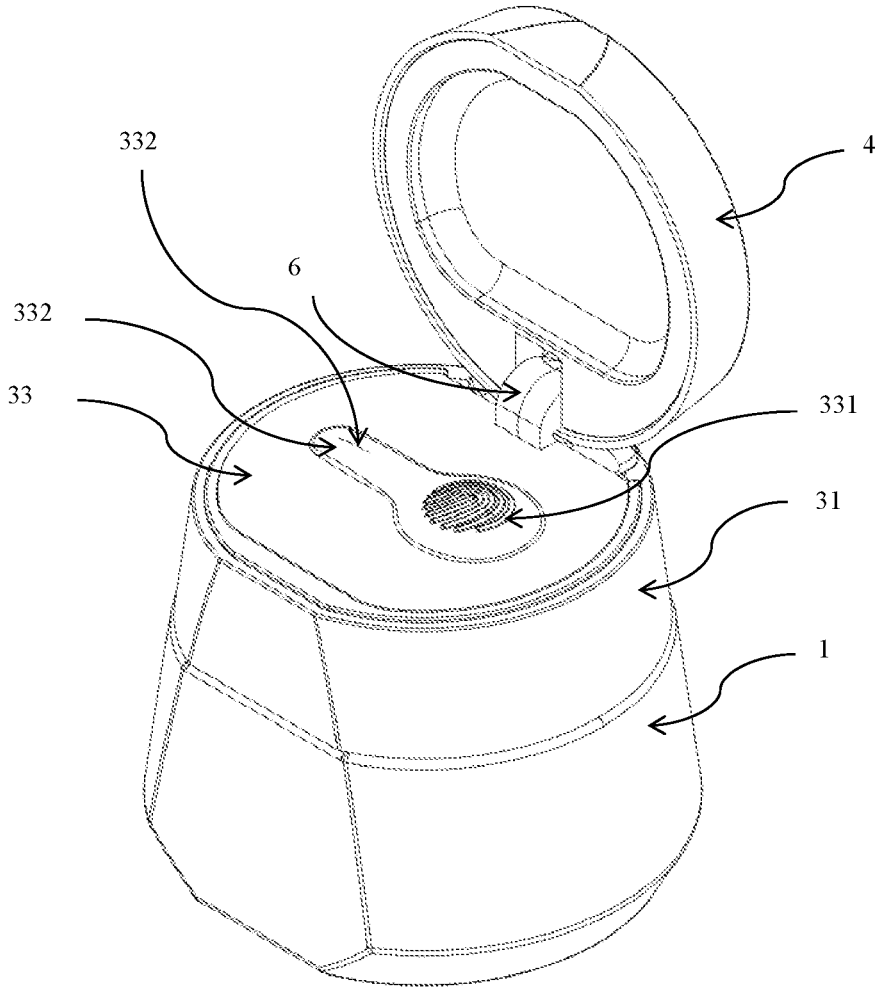
FIG. 7 is a conceptual diagram illustrating a three-dimensional structure of the eye cream packaging container in embodiment 2 of the present invention.
Figure 8:
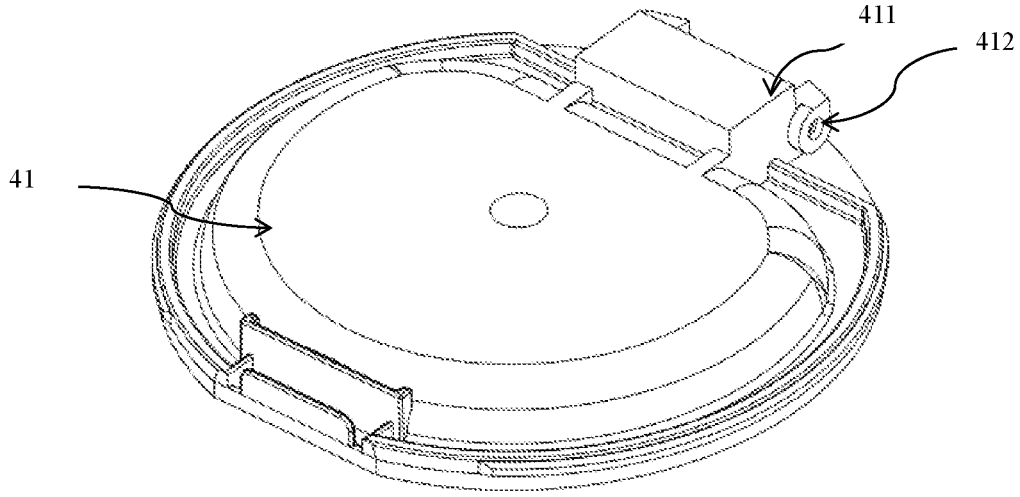
FIG. 8 is a conceptual diagram illustrating a three-dimensional structure of the inner container in embodiment 2 of the present invention.
Figure 9:
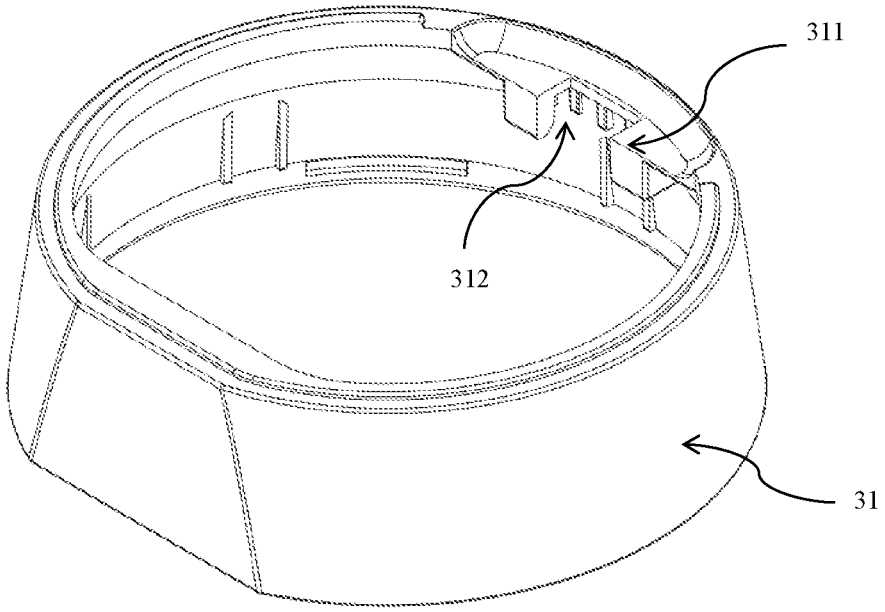
FIG. 9 is a conceptual diagram illustrating a three-dimensional structure of the middle seat in embodiment 2 of the present invention.
Figure 10:
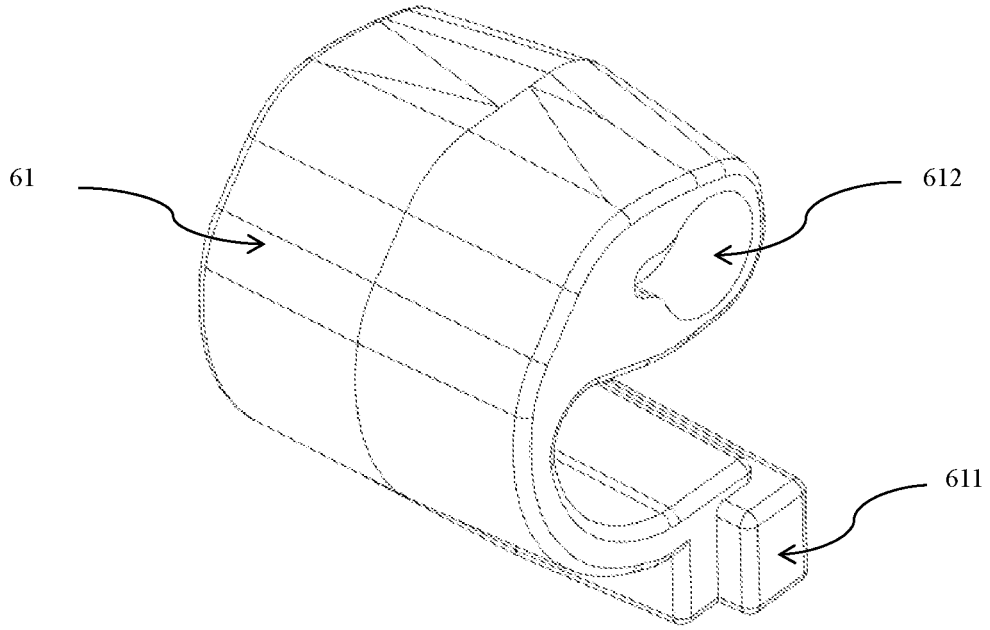
FIG. 10 is a conceptual diagram illustrating a three-dimensional structure of the crank arm connector in embodiment 2 of the present invention.

Referring to FIG. 4, the inner bottom of the inner container 21 is provided with a plurality of ribs 212, and the bottom of the inner container 21 is provided with a ventilation opening 213.

Embodiment 2

Referring to FIGS. 5, 6, 7, 8, 9 and 10, the eye cream packaging material of the present invention, comprising an outer bottle (1), wherein a material accommodating assembly 2 for accommodating a fluid material 5 to be dispensed is arranged in the outer bottle 1, a bottleneck 11 of the outer bottle 1 is connected with a material dispensing assembly 3 for allowing the fluid material 5 in the material accommodating assembly 2 to be pressed out, wherein air is prevented from being introduced during the whole process. In this embodiment, the outer bottle 1, the material accommodating assembly 2 and the material dispensing assembly 3 in embodiment 1 are the same as those in embodiment 2. The difference between them lies in their shapes. Moreover, the structure of the flip cover 4 in embodiment 1 differs from that in embodiment 2.

The material dispensing assembly 3 comprises a middle seat 31, a middle seat inner cover 32 and a flexible manual press cap 33. The flip cover 4 comprises an inner cover 41 and an outer cover 42 arranged outside the inner cover 41. The outer side wall of the inner cover 41 is provided with an inner cover notch 411. A clamping platform 311 is arranged on the inner side wall of the upper portion of the middle seat 31, and a clamping groove 312 is formed in the clamping platform 311. The inner cover notch 411 and the clamping groove 312 formed in the clamping platform 311 are rotatably connected through a hinge assembly 6, and the hinge assembly 6 is hidden in the outer cover 42.

The hinge assembly 6 comprises a crank arm connector 61, a spring 62 and a pin 63. The lower end of the crank arm connector 61 is provided with a connecting shaft 611, and the upper side of the crank arm connector 61 is provided with a via hole 612. The connecting shaft 611 is fixed in the clamping groove 312, the pin 63 penetrates through the via hole 612, and the two ends of the pin 63 are fixed in two ports 412 formed in the inner wall of the inner cover notch 411. The spring 62 is sleeved outside the pin 63, one end of the spring 62 is inserted into the via hole 612, and the other end of the spring 62 abuts against the inner wall of the outer cover 42. The inner cover 41 is capable of rotating axially relative to the crank arm connector 61 by taking the pin 63 as a rotating shaft.

The above are merely preferred embodiments of the present invention, which are not intended to limit the implementations and the scope of the present invention. For those skilled in the art, solutions may be obtained by using equivalent replacements and obvious modifications based on the specification and drawings of the present invention. Therefore, these solutions should all fall into the scope defined by the claims of the present invention.

What is claimed:

1. An eye cream packaging container, comprising:

an outer bottle (1) having a bottleneck (11);

a material accommodating assembly (2) for accommodating a fluid material (5) to be dispensed, wherein the material accommodating assembly (2) is arranged in the outer bottle (1), the material accommodating assembly (2) comprises an inner container (21) and a flexible material bag (22) accommodated in the inner container (21), wherein an upper end edge of the inner container (21) is connected to a top portion of the bottleneck (11) of the outer bottle (1) for accommodating the inner container (21) in the outer bottle (1), and an upper end edge of the flexible material bag (22) is sleeved outside an outer edge of the upper end of the inner container (21), wherein the flexible material bag (22) is flexible and deformable, and the inner container (21) is provided with a plurality of through openings (211);

a material dispensing assembly (3) connected to the outer bottle (1) via the bottleneck (11), wherein the material dispensing assembly (3) comprises a middle seat (31), a middle seat inner cover (32), a flexible manual press cap (33) and a negative pressure one-way valve plug (34), wherein the middle seat (31) is a structure provided with an upper opening, a lower opening, a clamping platform (311) and a clamping groove (312), the clamping platform (311) is secured on an inner side wall of an upper portion of the middle seat (31), the clamping groove (312) is formed on the clamping platform (311), the middle seat inner cover (32) is arranged in the middle seat (31), and the middle seat inner cover (32) is connected to an exterior portion of the bottleneck (11) of the outer bottle (1), the negative pressure one-way valve plug (34) is arranged in the middle seat inner cover (32), and the flexible manual press cap (33) is arranged at a top of the middle seat inner cover (32) in an airtight manner, and a middle of the flexible manual press cap (33) is provided with a convex pressing region (331) and a convex discharging region (332) placed adjacent to each other, a discharging notch (3321) is formed in the discharging region (332), the convex pressing region (331) and the convex discharging region (332) are provided with a small cavity, and the convex pressing region (331) is located on an upper side of the negative pressure one-way valve plug (34), the convex pressing region (331) and the negative pressure one-way valve plug (34) are substantially in a straight line, wherein when the convex pressing region (331) is pressed to deform, a negative pressure is formed in the convex pressing region (331), and when the convex pressing region (331) is released, the convex pressing region (331) is restored to an original state of the convex pressing region (331) under an elasticity of the convex pressing region (331), enabling the negative pressure one-way valve plug (34) to suck the fluid material (5) in the flexible material bag (22) up and propelling the flexible material bag (22) to deform and contract to open the discharging notch (3321);

a hinge assembly (6); and a flip cover (4) comprising an inner cover (41), an outer cover (42) and an inner cover notch (411), wherein an outer side wall of the inner cover (41) is secured to the inner cover notch (411), the outer cover (42) is placed above the inner cover (41), wherein the inner cover notch (411) and the clamping groove (312) are rotatably connected via the hinge assembly (6).

2. The eye cream packaging container of claim 1, wherein the middle seat inner cover (32) is provided with a through hole (323), and the one-way valve plug (34) is arranged in the through hole (323), wherein a plurality of anti-blocking columns (321) are arranged at the bottom of the one-way valve plug (34) along the periphery of a lower end of the through hole (323), and a through opening is formed between every two adjacent anti-blocking columns (321).

3. The eye cream packaging container of claim 1, wherein bottom of the flexible manual press cap (33) is provided with a manual press cap tray (333), and top of the middle seat inner cover (32) is provided with an annular protruding edge (322), wherein the manual press cap tray (333) is connected to the annular protruding edge (322).

4. The eye cream packaging container of claim 1, wherein an upper end edge of the flexible material bag (22) interacts with the upper end edge of the inner container (21) and the middle seat inner cover (32) in an airtight manner.

5. The eye cream packaging container of claim 1, wherein top of the middle seat (31) is connected to the flip cover (4), and when the flip cover (4) is in a closed state, the opening at the top of the middle seat (31) is sealed.

6. The eye cream packaging container of claim 1, wherein the hinge assembly (6) further comprising a crank arm connector (61), a spring (62) and a pin (63), wherein a lower end of the crank arm connector (61) is provided with a connecting shaft (611), and an upper side of the crank arm connector (61) is provided with a via hole (612), wherein the connecting shaft (611) is fixed in the clamping groove (312), wherein the pin (63) penetrates through the via hole (612), and wherein the two ends of the pin (63) are fixed in two ports (412) formed in the inner wall of the inner cover notch (411), wherein the spring (62) is sleeved outside the pin (63), wherein one end of the spring (62) is inserted into the via hole (612), and the other end of the spring (62) is adjacent to the inner wall of the outer cover (42).

7. The eye cream packaging container of claim 1, wherein thickness of the flexible material bag (22) is consistent, wherein the flexible material bag (22) is made of one of materials selected from silica gel, thermoplastic elastomer, thermoplastic rubber and styrenic thermoplastic elastomer.

8. The eye cream packaging container of claim 1, wherein the one-way valve plug (34) and the flexible manual press cap (33) are made of one of materials selected from silica gel, thermoplastic elastomer, thermoplastic rubber and styrenic thermoplastic elastomer.

9. The eye cream packaging container of claim 1, wherein inner bottom of the inner container (21) is provided with a plurality of ribs (212), and bottom of the inner container (21) is provided with a ventilation opening (213).

10. The eye cream packaging container of claim 1, wherein both the inner container (21) and the flexible material bag (22) are configured to be a shape selected from a hollow cylinder, a cube, a cuboid, a prism or a circular truncated cone.

11. The eye cream packaging container of claim 1, wherein the fluid material (5) is selected from one of the following: an eye cream, a drug, an aqueous solvent and an emulsion.

* * * * *